United States Patent [19]

Murray et al.

[11] 4,336,565

[45] Jun. 22, 1982

[54] CHARGE PROCESS WITH A CARBON FIBER BRUSH ELECTRODE

[75] Inventors: Hugh Murray; Lawrence M. Marks, both of Mississauga, Canada

[73] Assignee: Xerox Corporation, Stamford, Conn.

[21] Appl. No.: 174,783

[22] Filed: Aug. 4, 1980

[51] Int. Cl.[3] ..... G03G 13/02

[52] U.S. Cl. ..... 361/225; 355/3 CH; 361/221; 430/35

[58] Field of Search ..... 361/225, 221; 355/3 CH; 118/638, 649; 427/32; 430/35; 250/325

[56] References Cited

U.S. PATENT DOCUMENTS

| | | | |
|---|---|---|---|
| 1,396,318 | 11/1921 | Bunger | 361/214 |
| 2,449,972 | 9/1948 | Beach | 361/212 |
| 2,774,921 | 12/1956 | Walkup | 118/647 X |
| 3,671,806 | 6/1972 | Whitmore et al. | 361/212 |
| 3,691,993 | 9/1972 | Krause et al. | 118/638 |
| 3,757,164 | 9/1973 | Bunkowski | 361/212 |
| 3,904,929 | 9/1975 | Kanaya et al. | 361/220 |

FOREIGN PATENT DOCUMENTS

| | | | |
|---|---|---|---|
| 976027 | 11/1964 | United Kingdom | 361/225 |

*Primary Examiner*—Evan K. Lawrence

[57] ABSTRACT

A process of imposing an electrical charge on an electrically insulating surface of a moving web wherein a brush electrode contacts the surface. The brush is made up of extremely soft and flexible fiber filaments comprising carbon mounted on a metallic brace which also serves as an electrical contact to supply the brush with d.c. potential whereby the electrically insulating surface is charged to nearly the potential applied to the brush.

In order to improve charge uniformity the brush is oscillated in a direction transverse to the direction of web movement.

7 Claims, 5 Drawing Figures

CHARGE PROCESS WITH A CARBON FIBER BRUSH ELECTRODE

Figure 1:
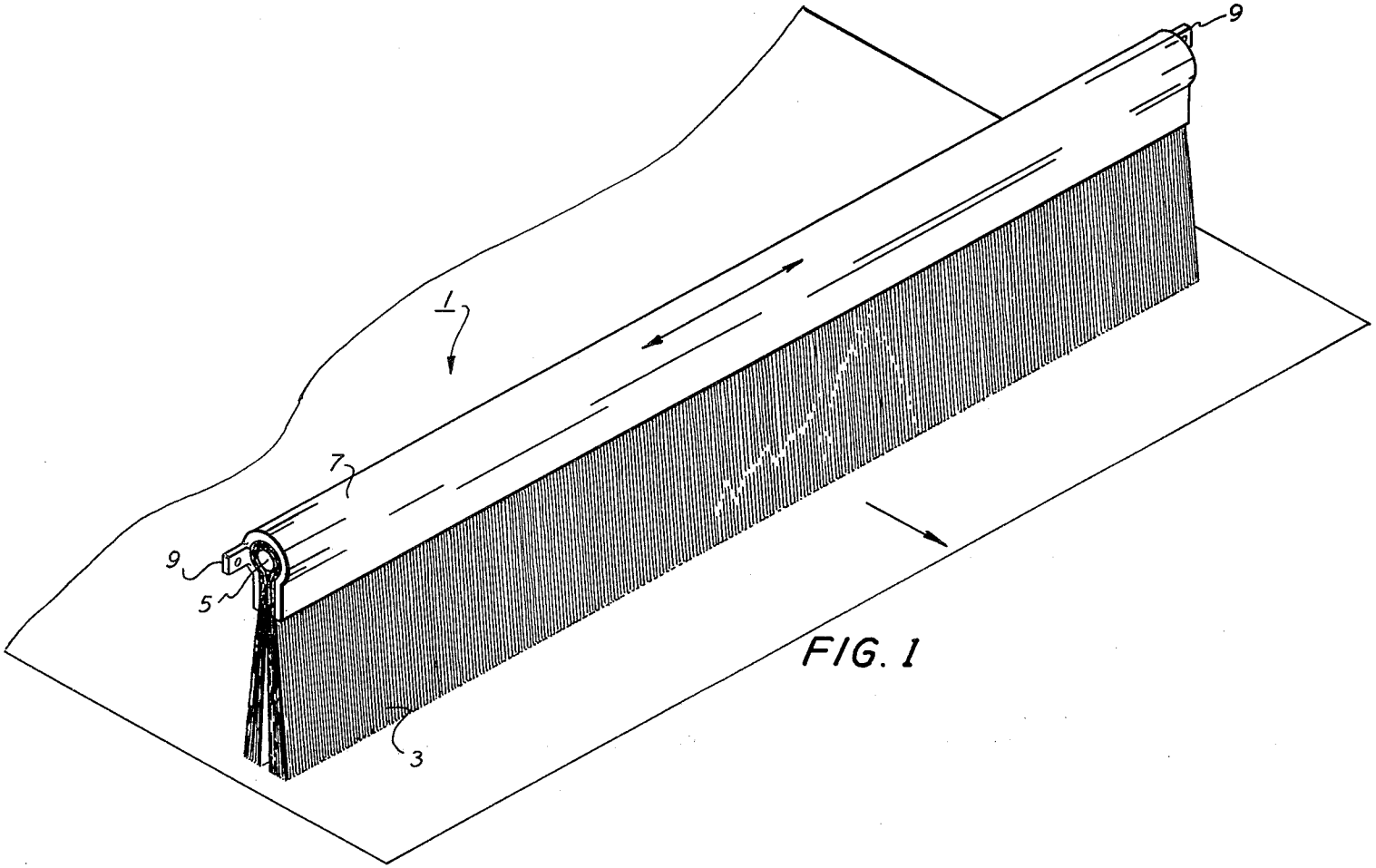

This invention relates to a novel contact charging method and more particularly to a brush-type charging electrode employed to impose an electrical charge on an electrically insulating surface.

The problem of uniformly charging a dielectric surface is common to many industrial applications. Most particularly, the uniform charging of a dielectric surface to a relatively high potential occurs in modern copying processes which utilize electrostatic charge patterns in some manner or form to create a visible image. Electrostatic charge is normally applied uniformly to a surface and then eliminated in imagewise configuration. In recent years, the tendency in the copying industry has been to increase the speed with which copies are made resulting in a great increase in the speed of the internal mechanism of the copying machine. There is thus required an efficient means to electrostatically charge the surface of an electrically insulating material at high speed yet in a very uniform manner.

Various brush devices have been known in the prior art and have been advantageously utilized for many purposes. For example, a brush-type electrode has been utilized in a copy machine for transferring a developed electrostatic image from an image bearing member to a medium such as copy paper in response to an electric field produced by a fiber brush roller. Normally, the brush is a metallized fiber brush, metal brush, or fiber brush rendered conductive. One example of such a brush electrode is found in U.S. Pat. No. 3,691,993 to Krause et al. In another example utilizing a brush-type electrode, there is disclosed in U.S. Pat. No. 3,671,806 to Whitmore et al. a plush fiber brush rendered partially conductive by the addition of various conductive salts to the fibers. According to this patent, the electrostatic charge on a surface is regulated by a controlled application of voltage to the brush electrode. By being able to apply either positive or negative voltage to the brush as needed, the amount of static electrical charge on the surface of an electrically insulating member is controlled. A monitor is associated with the brush electrode so as to control the polarity and amount of charge on the brush electrode.

As mentioned above, brush electrodes have been utilized to neutralize or control small amounts of static electrical charges present on a sheet or web by contacting the sheet or web with the bristles of a grounded metallic brush electrode. Other examples of such devices are found in U.S. Pat. No. 1,396,318 to Bunger and U.S. Pat. No. 2,449,972 to Beach. More modern examples of brush electrodes utilized for the purpose of electrodischarging are found in U.S. Pat. No. 3,757,164 to Binkowski and U.S. Pat. No. 3,904,929 to Kanaya et al. All of these patents have in common the use of conductive fibers as the discharge electrode.

Brush electrodes have been utilized for contact discharging and other uses such as image transfer as shown in the above-mentioned U.S. Pat. No. 3,691,993. Such brushes have been found to have certain deficiencies which make them unattractive for commercial use wherein long periods of utility are desirable. For example, a fine wire brush electrode such as described in U.S. Pat. No. 3,691,993 have been found to become irregular because the metal fibers tend to twist one upon the other thus matting the fiber brush making it nonuniform in surface contact. This results in a non-uniform operation of the device. Also, the wire brush causes a polymeric web to be badly worn in a short period of time.

Many imaging systems require extremely high fields which are conveniently provided on electrically insulating surfaces as static charges. Normally, corotron devices are utilized but as speeds increase and the required electrical field strength increases, corotrons have been found to be less attractive in view of the large power supply required and the amount of ozone produced. Thus, there is needed a convenient method for charging electrically insulating surfaces to a high potential at high speed without the production of undesirable contaminants in the atmosphere and attendant large power supplies to supply the extremely high voltage required for a corotron charging device to charge such surfaces to high potential.

In accordance with this invention, there is provided a convenient process for charging electrically insulating surfaces to high potential at high speeds which method comprises applying a brush electrode to the electrically insulating surface of a moving web which brush comprises soft, flexible fiber filaments comprising elemental carbon. When such a carbon fiber filament brush electrode is placed under high potential, it has been found that the electrically insulating surface contacted by the brush is brought to within a few hundred volts of the potential applied to the brush. Since carbon fiber filaments are relatively stiff in one direction yet soft, they have been found not to entangle upon one another and remain uniformly oriented within the brush for extremely long periods of time. The surface charged by the device of this invention suffers much less wear than experienced with metal brush electrodes because of the relatively softer carbon fibers. Thus, such surfaces have extended usable lifetimes. Either one or a plurality of brushes may be employed in sequential manner to charge the electrically insulating surface. Further improvement in charge uniformity is achieved by means of oscillating the brush electrode in a direction transverse to the direction of web movement. Such oscillation also inhibits the bunching of fibers.

In FIG. 1 there is shown a diagramatic view of the carbon fiber filament brush of this invention being used to charge a moving web.

Figure 2:
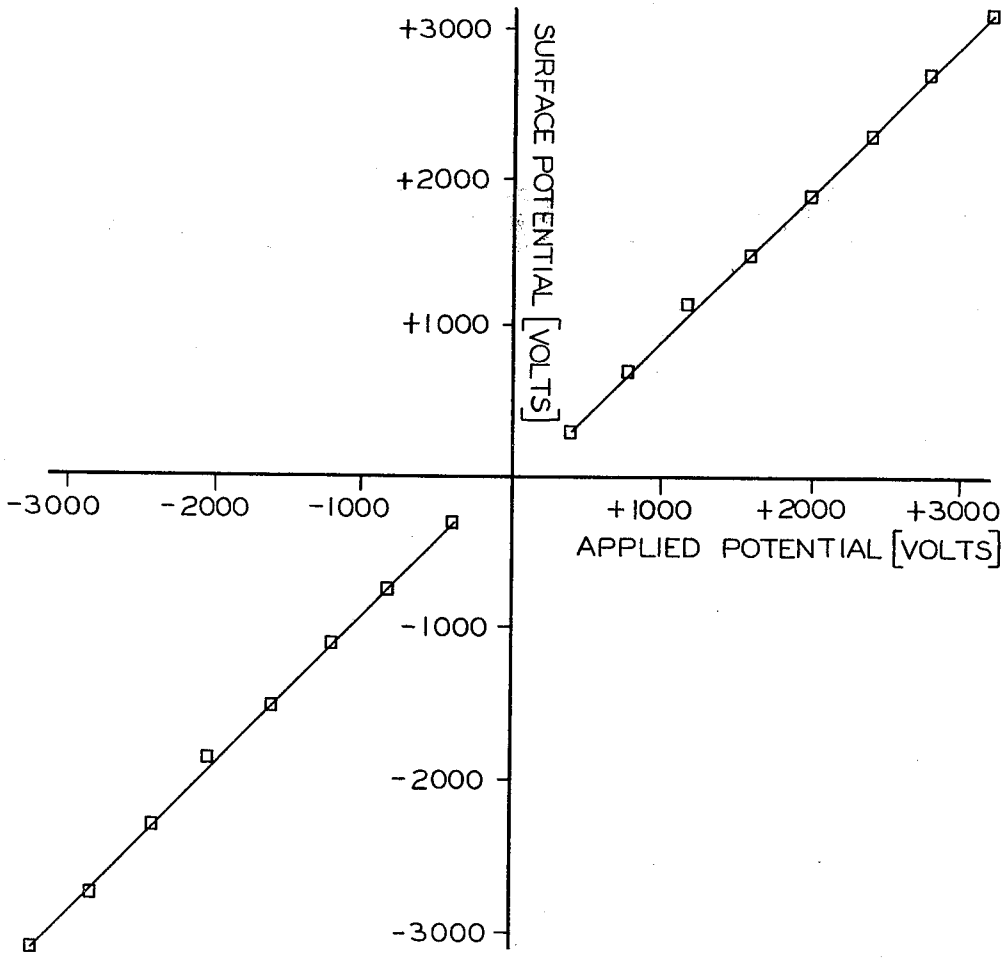

In FIG. 2, there is shown a graph indicating the results of charging experiments wherein an electrical potential on an insulating surface is compared to a potential applied to the brush electrode of this invention held in contact with said surface.

Figure 3A:
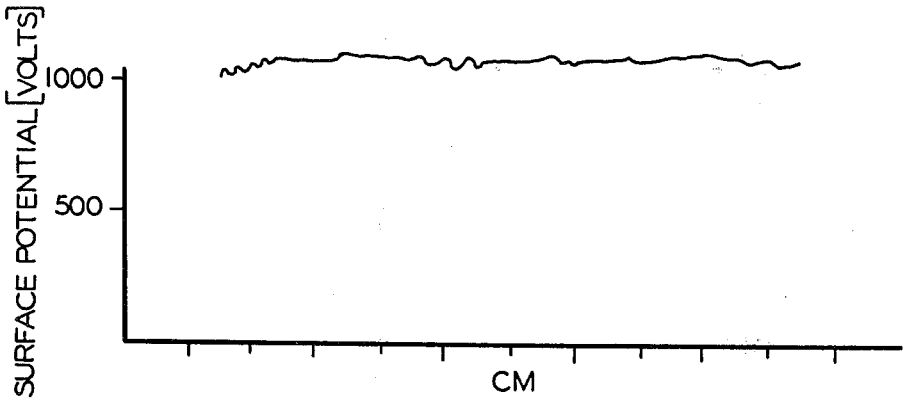
Figure 3B:
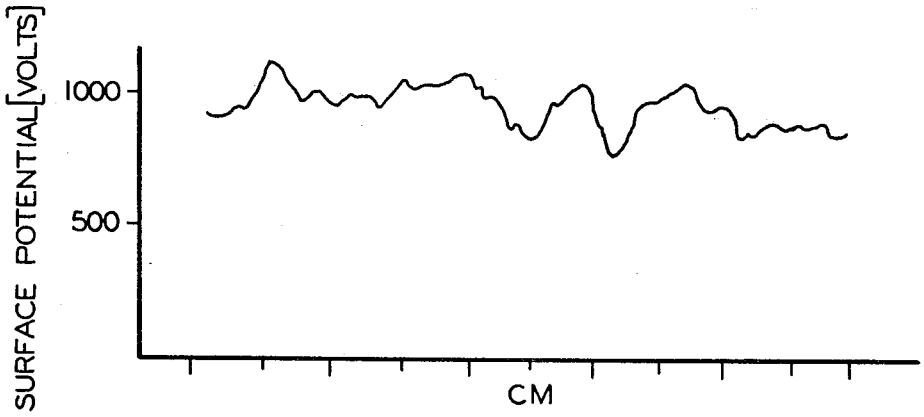

FIG. 3 shows a pair of graphs indicating the amount of charge potential measured laterally across the surface of an electrically insulating web. In FIG. 3(*a*), there is shown the measured surface potential of said web charged by means of the process of this invention. In FIG. 3(*b*), there is shown the measured surface potential across said web charged by means of passing said web beneath a typical corotron charging device set at a negative potential designed to provide the same amount of charge on the surface as imposed by the fiber filament brush utilized in FIG. 3(*a*). The corotron discharging device is typical of the prior art.

Figure 4:
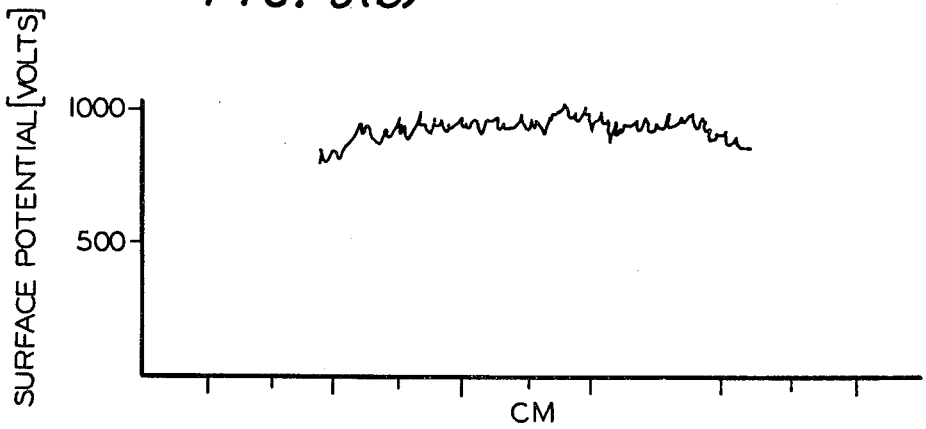

In FIG. 4, there is shown, in graphical form, the measured surface potential across the surface of an electrically insulating web charged by means of contact with a metal brush having bristles of comparative size to the carbon fiber filament brush of FIG. 3(*a*). The applied potential to the metal brush is the same as applied to the carbon brush of FIG. 3(*a*).

In FIG. 1, there is shown a carbon fiber filament brush charging electrode device of this invention 1 wherein conductive carbon fiber filaments 3 are wrapped around a support rod 5. The filaments 3 are retained in position on rod 5 by a U-shaped conductive exterior shield 7. The shield also includes a pair of pierced tabs 9 at its ends to provide means for mounting and connecting the device to an electrical circuit. The brush is oscillated in a direction transverse to the direction of movement of the web 10 as shown by the arrows.

Although FIG. 1 illustrates the brush electrode in the form of a planar bristle brush, the process of this invention can be operated utilizing such a brush in a roller configuration. In such configuration, the conductive carbon filaments are mounted in a conductive resilient base which base is then wrapped around a conductive roller associated with an electrical power supply. However, extremely uniform charging has been achieved utilizing the planar brush configuration as is illustrated in FIG. 1.

Further improvement in charge uniformity is achieved by means of oscillating the brush electrode in a direction transverse to the direction of movement of the web 10. Such oscillation inhibits the bunching of fibers.

The carbon fiber filaments 3 are provided by a carbonization of polymeric material. For example, such fiber material can be provided by the carbonizing of rayon yarn as described in U.S. Pat. No. 3,235,323. Additives can be combined with the polymer such as described in U.S. Pat. No. 3,484,183. Other polymers such as polypropylene have been advantageously converted to carbon in the filament form and utilized in the process of this invention. A commercially available carbon fiber filament brush is distributed through the stereophonic sound recording market wherein the carbon fiber filament brush is utilized as a record cleaner and static eliminator. Such brush is manufactured by Decca, Ltd. of London, England. Another commercially available carbon fiber filament is Thornel graphite yarn commercially available from Union Carbide Corp.

Typically, the carbon fiber filaments are supplied in non-twisted strands of 720 individual filaments, each filament being from about 7 to about 10 microns in diameter. To promote uniform contact at charging, the carbon fiber filaments are usually from about 0.5 cm. to 1 cm. in length extending beyond the protective metal cover 7. The width of the charging device is usually slightly wider than the area desired to be charged and is brought into intimate contact with the electrically insulating surface while an electrical potential is applied to the filaments. As with prior art charging devices, a ground plane is required on the side of the material to be charged opposite the charging device. As an example of operation, a polyester web is charged by means of the device illustrated in FIG. 1. A typical polyester web is comprised of polyethylene terephthalate available from the E. I. du Pont de Nemours & Co., Inc. under the tradename Mylar. A web of Mylar is mounted on a pair of rollers and rotated at a constant speed of about 10 cm/sec. while a range of applied voltages between 400 volts and 3200 volts, in 400 volt steps for both polarities, is applied to the carbon fiber filaments. The amount of charge on the web is measured by means of an electrostatic volt meter connected to a pen recorder by which the average surface potential is recorded. Between each measurement of applied potential, the web surface is discharged to near ground potential by grounding the brush electrode and allowing the web to pass under it several times. The results of the measurements are plotted in FIG. 2 from which it can be seen that the brush electrode has a linear voltage charging characteristic. Also, the resulting average surface potential is only a few hundred volts less than the voltage applied to the brush electrode. As can be seen from FIG. 2, the average surface potential is usually in the range of about 100 volts less than the potential applied to the brush electrode whether the polarity is positive or negative.

Charge uniformity on the surface charged by the process of this invention, a very important characteristic in electrophotography, was determined by directly scanning the surface potential on a charged Mylar web with an electrostatic volt meter. The probe of the electrostatic volt meter has a resolution of approximately 1.6 millimeters in diameter to within 95 percent of rated accuracy. The charge uniformity provided by the method of the present invention is compared to a typical corotron charging device currently widely used in commercial electrophotographic machines. The results of the measurements are shown in FIGS. 3(*a*) and (*b*). Both the corotron and the brush electrodes are utilized to charge the web surface to the same negative potential at the speed of 10 cm/sec. FIG. 3(*a*) indicates a charge uniformity with small variation produced by the process of this invention utilizing the carbon brush contact electrode. FIG. 3(*b*) indicates great variation across the surface of the web produced by charging with a corotron held at a negative potential. As can be seen from FIGS. 3(*a*) and (*b*), the charging method of this invention utilizing a carbon fiber filament contact electrode provides greatly improved charging with respect to uniformity over the traditional corotron charging device elevated to a negative potential. Although not shown, when applying positive polarity to each of the corotron and brush electrode, the uniformity of charge across the surface appears to be about equal.

FIG. 4 provides a comparison of the process of this invention with the charging process utilizing a steel fiber brush electrode for the purpose of charging an electrically insulating surface. As can be seen in FIG. 4, the amount of charge is highly irregular across the surface of the web contacted by the steel fiber brush electrode which was held in contact with the web in similar manner as with the carbon fiber filament brush of this invention. The steel fibers were manufactured as "steel pile" by the Shlegal Corporation of Rochester, N.Y. and provides a dense matrix of 8 micron diameter stainless steel fibers. The steel brush is held in contact with the web surface under the same conditions of web speed and applied potential as utilized with the carbon fiber filament brush electrode in accordance with the process of this invention. The comparison of FIGS. 4 and 3(*a*) provides dramatic evidence of the improved charging results achieved by the process of this invention.

In accordance with the process of this invention, improved charging of electrically insulating surfaces is provided. High charge density and excellent uniformity of charge is attained at high speeds. Typically, the potential on the surface achieved by the process of this invention has been in the range of from about 400 volts to about 10,000 volts. At surface potential below 400 volts, the charging characteristics of the carbon fiber filament brush electrode becomes non-linear. Polymeric surfaces may be charged by contacting such surfaces with carbon fiber filaments held under applied potential without noticeable wear of the surface for extended operating lifetimes.

It is to be understood that the above-described method and arrangements are simply illustrative of the application of the principles of the invention and that many modifications may be made without departing from the spirit and scope thereof.

What is claimed is:

1. A process for applying an electrostatic charge on the electrically insulating surface of a moving web which comprises contacting the surface with at least one brush electrode raised to an applied potential, said brush electrode being made with electrically conductive carbon fiber filaments, and oscillating said at least one brush electrode in a direction transverse to the direction of the web movement.

2. The process of claim 1 wherein the applied potential is in the range of from about 400 to about 10,000 volts.

3. The process of claim 1 wherein the carbon fiber filaments are derived from cellulose.

4. The process of claim 1 wherein the carbon fiber filaments are derived from polypropylene.

5. The process of claim 1 wherein the fiber filaments have a diameter in the range of from about 7 microns to about 10 microns.

6. The process of claim 1 wherein the filaments have a length of about 1 cm.

7. The process of claim 1 wherein a plurality of said brush electrodes contact said surface sequentially.

* * * * *